US005913353A

United States Patent [19]

Riley et al.

[11] Patent Number: 5,913,353

[45] Date of Patent: Jun. 22, 1999

[54] PROCESS FOR CASTING LIGHT METALS

[75] Inventors: James Edward Riley, Northville; Curtis Neal Paige, Dearborn Heights, both of Mich.

[73] Assignee: Ford Global Technologies, Inc., Dearborn, Mich.

[21] Appl. No.: 09/047,000

[22] Filed: Mar. 24, 1998

Related U.S. Application Data

[62] Division of application No. 08/603,400, Feb. 20, 1996, abandoned, which is a continuation of application No. 08/311,986, Sep. 26, 1994, abandoned.

[51] Int. Cl.[6] ..... B22C 17/00; B22C 3/00; B22C 23/00; B22C 27/04

[52] U.S. Cl. ..... 164/113; 164/72; 164/122; 164/66.1; 164/125; 164/126

[58] Field of Search ..... 164/113, 72, 122, 164/268, 66.1, 125, 126

[56] References Cited

U.S. PATENT DOCUMENTS

| | | | |
|---|---|---|---|
| 2,660,769 | 12/1953 | Bennett . | |
| 2,882,142 | 4/1959 | Keating . | |
| 3,268,960 | 8/1966 | Morton . | |
| 3,753,690 | 8/1973 | Emley et al. . | |
| 3,833,050 | 9/1974 | Kashuba et al. . | |
| 3,999,593 | 12/1976 | Kaiser . | |
| 4,072,181 | 2/1978 | Kostura et al. . | |
| 4,146,081 | 3/1979 | Reis . | |
| 4,153,100 | 5/1979 | Balevski et al. . | |
| 4,298,187 | 11/1981 | Dantzig et al. . | |
| 4,391,319 | 7/1983 | Heaslip et al. . | |
| 4,425,932 | 1/1984 | Herman . | |
| 4,635,706 | 1/1987 | Behrens . | |
| 4,658,881 | 4/1987 | Sasaki . | |
| 4,691,755 | 9/1987 | Kuriyama et al. . | |
| 4,798,237 | 1/1989 | Nakano . | |
| 4,813,470 | 3/1989 | Chiang . | |
| 4,817,700 | 4/1989 | Milov et al. . | |
| 4,854,370 | 8/1989 | Nakamura . | |
| 4,967,827 | 11/1990 | Campbell . | |
| 5,076,339 | 12/1991 | Smith | 164/72 |
| 5,114,472 | 5/1992 | Eckert et al. . | |
| 5,205,346 | 4/1993 | Kuhn et al. . | |
| 5,246,055 | 9/1993 | Fields et al. . | |
| 5,263,531 | 11/1993 | Drury et al. | 164/113 |
| 5,309,975 | 5/1994 | Ohnishi et al. . | |
| 5,316,070 | 5/1994 | Rogers et al. | 164/122 |
| 5,370,171 | 12/1994 | Fields et al. . | |
| 5,388,633 | 2/1995 | Mercer, II et al. . | |
| 5,393,039 | 2/1995 | Smith . | |
| 5,435,373 | 7/1995 | Drane et al. | 164/72 |

OTHER PUBLICATIONS

Transactions, 17th International Die Casting Congress and Exposition, Oct. 18–21, 1993, Cleveland, Ohio, pp. 49–53.

At The Threshold, 48th Annual World Magnesium Conference, pp. 27–28.

*Magnesium Properties and Applications for Automobiles,* SAE SP–962, p. 71.

*Product Design in Recyclable Al, Mg, Zn & ZA Alloys,* The OEM Design Sourcebook, 2nd Ed., p. 80.

*Primary Examiner*—Patrick Ryan
*Assistant Examiner*—I.-H. Lin
*Attorney, Agent, or Firm*—Joseph W. Malleck; Roger L. May

[57] ABSTRACT

A process for casting light metals. The process includes preheating ingots of the light metal in a protective atmosphere before being introduced into a melting furnace wherein the molten metal is degassed and filtered before transference in a heated delivery tube to a covered holding furnace. The filtered melt is made quiescent to reduce its kinetic energy and allow inclusions to settle and form a purified melt. A vacuum is applied to a die cavity in a casting press to displace air residing therein with an inert atmosphere. The purified melt is then transferred in a heated delivery tube as a charge to the casting press under the inert atmosphere to prevent burning and formation of accompanying reaction products. Upon cooling, a light metal casting is produced in the absence of air with minimum defects and inclusions.

2 Claims, 2 Drawing Sheets

PROCESS FOR CASTING LIGHT METALS

This is a divisional of application(s) Ser. No. 08/603,400, filed on Feb. 20, 1996 and now abandoned, which is a file wrapper continuation of Ser. No. 08/311,986, filed on Sep. 25, 1994 and now abandoned.

TECHNICAL FIELD

The present invention relates to a process and apparatus for the die casting of light metals.

BACKGROUND ART

As automotive and other industries strive to reduce the weight and enhance the quality of their products, a need has arisen for lightweight materials which can be used in structural components where a high level of confidence in performance is required.

High-pressure die casting (HPDC) is a process used for economically producing large volumes of industrial castings. HPDC offers the attributes of excellent surface finish, nearness to net shape, dimensional accuracy, thin walls, and fine detail. However, HPDC has thus far been unable to match the quality of other casting processes. For example, gravity casting processes are routinely expected to produce high-integrity castings. HPDC has a reputation of being a process which involves a number of limiting casting defects. Such defects include high levels of porosity from entrapped gas and solidification shrinkage, linear defects from incoherent streams of metal flow, and cracking from cooling stresses. To address such concerns, today's practitioner usually designs load-bearing die castings so that they incorporate a large safety factor. Accordingly, HPDC has tended to be relegated to applications involving less stringent load or pressure bearing requirements.

The HPDC industry continues to address the issue of casting defects. Some effort has been focused on developing enhanced HPDC processes which attempt to overcome the perceived quality shortcomings in relation to other casting processes, while retaining inherently high productivity.

The North American Die Casting Association on Oct. 18, 1993 presented a paper entitled "Two-Furnace Melting System For Magnesium," authored by Holta, et al. That paper discussed the problems of melting alloy ingots of light metals such as magnesium and transferring them to a casting machine. The paper discussed the introduction of protective gas mixtures and the utilization of heated steel tubes for melt handling. Also disclosed was a siphon tube to feed a die casting machine.

SUMMARY OF THE INVENTION

In the process for casting light metals according to the present invention, the main process steps are:

1. preheating ingots, metal feed stock, or charges of the light metal in a protective atmosphere so that they retain their solidified state, expel volatile substances, and avoid excessive heat losses in a melting furnace to which the ingots are introduced;
2. introducing the preheated ingots into the melting furnace under the protective atmosphere to prepare molten metal;
3. degassing the molten metal to remove dissolved gas, remove suspended oxides and inclusions and form degassed molten metal;
4. passing the degassed molten metal through a filtering medium to sift out nonmetallic and metallic oxide inclusions and form a filtered melt;

5. transferring the filtered melt without exposure to air in a heated delivery tube for reducing loss of thermal energy to a covered holding furnace also having a protective atmosphere;
6. making the filtered melt quiescent to reduce its kinetic energy, thereby permitting inclusions to settle and form a purified melt;
7. applying reduced pressure to a casting press having a die cavity and an entrance to displace air residing in the die cavity with an inert atmosphere;
8. transfer the purified melt as a charge into the casting press in the inert atmosphere to prevent burning and formation of accompanying reaction products;
9. displacing the charge by a piston into the die cavity; and
10. allowing the charge to cool and form the light metal casting in the absence of air under a reduced pressure with minimum defects and inclusions.

The apparatus used to practice the above process for manufacturing light metal casting includes:

1. one or more enclosed preheaters of ingots of the light metal;
2. one or more closed melting furnaces into which are loaded the preheated ingots of the light metal in a protective atmosphere to prepare molten metal, the one or more melting furnaces each including
   a. means for degassing the molten metal located within the melting furnace to remove dissolved gas, oxides, and inclusions to form degassed molten metal;
   b. a filtering medium located within the melting furnace to sift out inclusions and oxides from the degassed molten metal to form a filtered melt;
3. means for transferring the degassed molten metal, such as a delivery tube, connected to one or more the melting furnaces for transferring the filtered melt without exposure to air therefrom;
4. a covered holding furnace connected to the delivery tube, the covered holding furnace having a protective atmosphere under which the filtered melt may be made quiescent to reduce its kinetic energy, thereby permitting inclusions and oxides to settle and form a purified melt;
5. a heated transfer means for transferring the purified melt from the holding furnace;
6. a casting press having a die cavity and an entrance thereto;
7. means for applying a vacuum to the die cavity for replacing air in the die cavity with an inert atmosphere to prevent burning and formation of accompanying reaction products; and
8. means for charging the purified melt into the die cavity before cooling the charge and forming the light metal casting in the absence of air with minimum porosity and defects.

Further features and advantages of the present invention will be apparent from the following detailed description taken in conjunction with the accompanying drawings.

BEST MODE(S) FOR CARRYING OUT THE INVENTION

Figure 1:
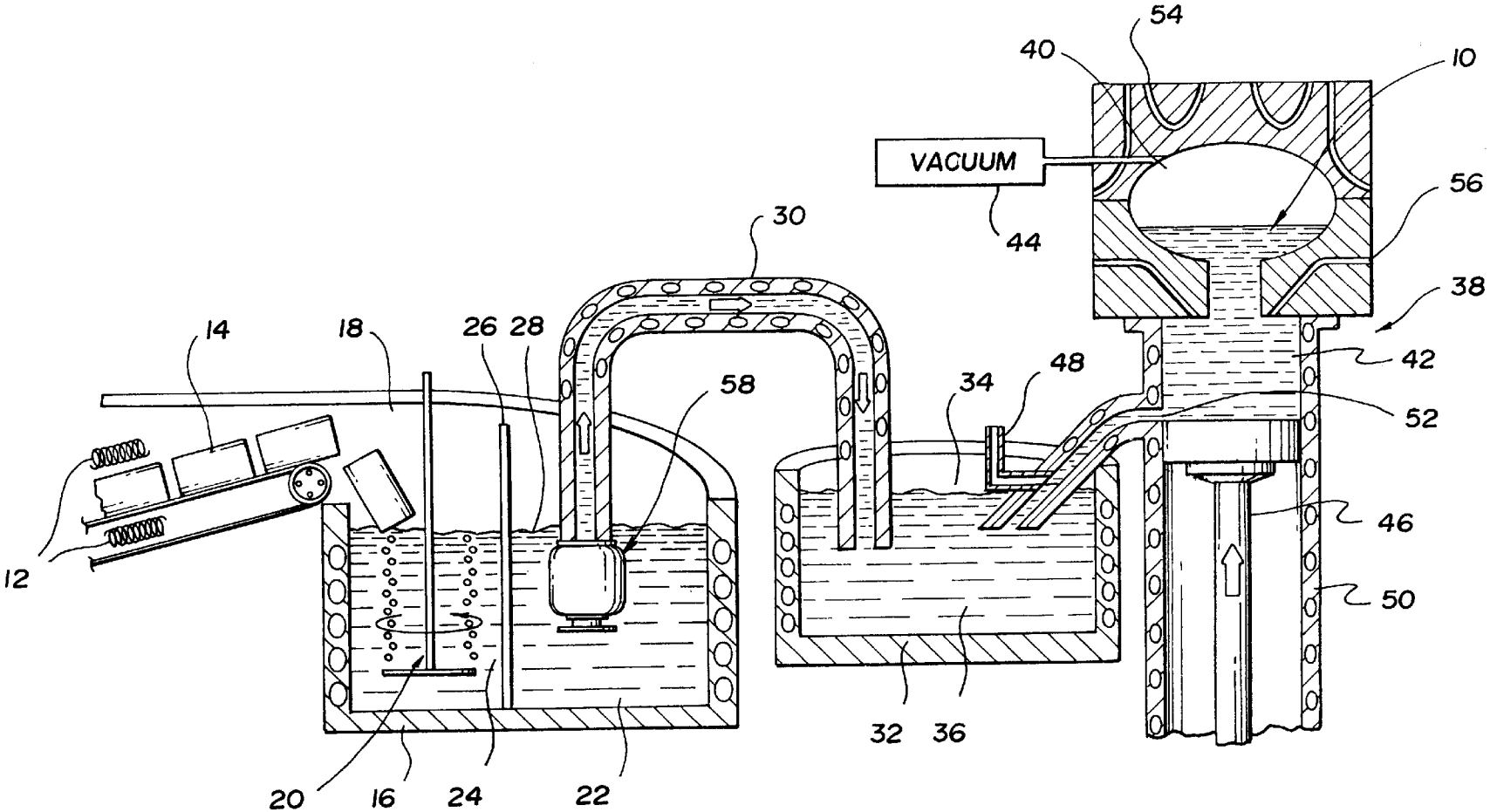
FIG. 1 depicts a schematic cross-sectional view of an apparatus for manufacturing light metal castings.

In FIG. 1 of the drawing, there is depicted an apparatus for manufacturing light metal castings. That apparatus will first be described before turning to the process details.

Figure 2:
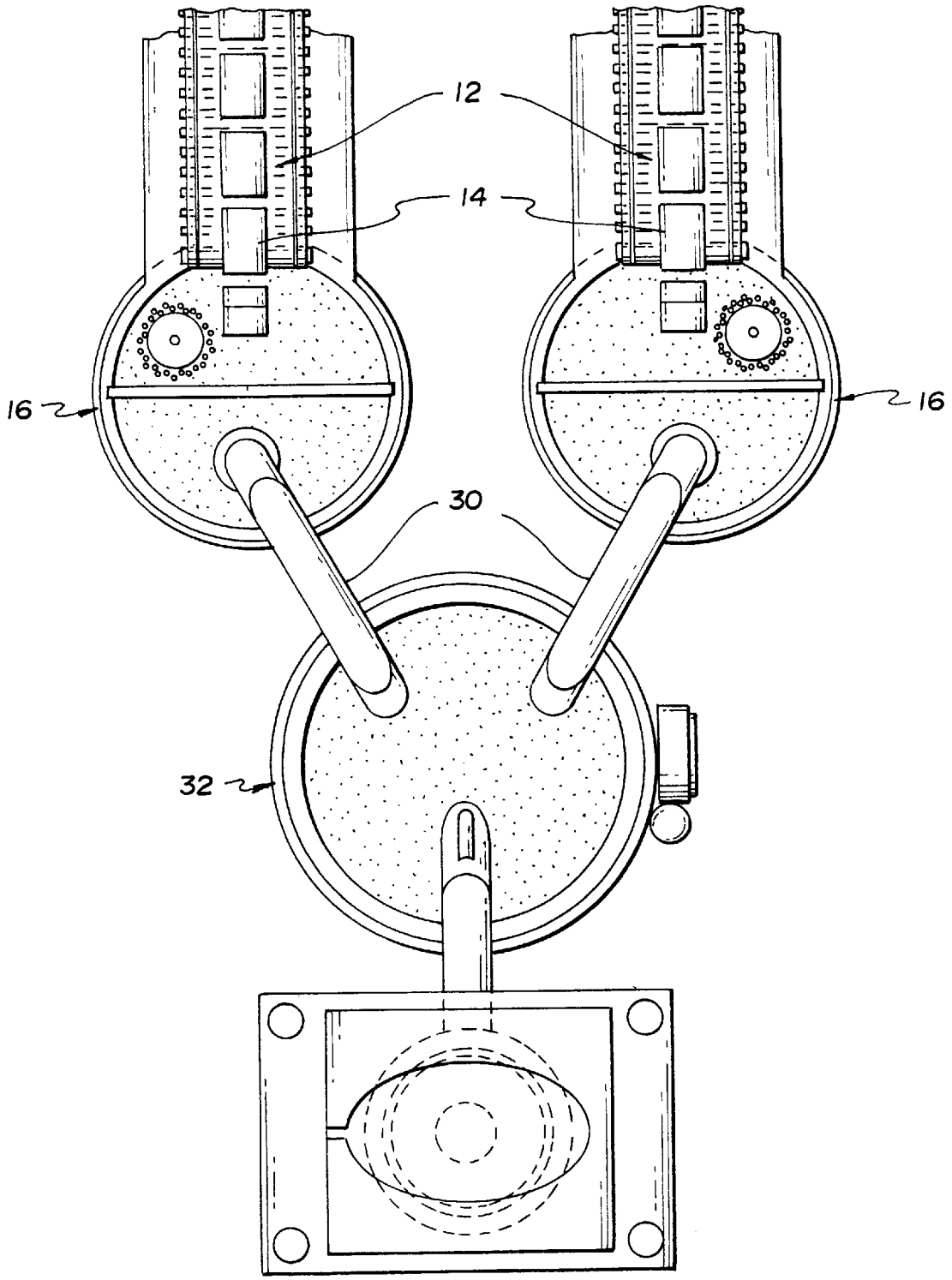
FIG. 2 depicts an alternate embodiment of the present invention.

In FIG. 1, there is a side elevational view of a section through the apparatus of the present invention. In FIG. 2, there is a top plan view of a section through a preferred embodiment thereof. In FIG. 2, there are two melting furnaces 16. In these figures, there are one or more enclosed preheaters 12 of ingots 14 of the light metal, such as lithium, magnesium, beryllium, aluminum, and other light nonferrous metals having a molecular weight below 10.

The one or more melting furnaces 16 accommodate the preheated ingots of the light metal in a protective atmosphere 18 which lies above a meniscus of molten metal contained in each melting furnace 16. Preferably, the protective atmosphere includes $SF_6$ (sulphur hexafluoride), dry air, and $CO_2$ (carbon dioxide). Each melting furnace 16 includes a lid which helps create a closed system.

Each melting furnace 16 includes means for degassing the molten metal so that dissolved gas, oxides, and inclusions are removed to form degassed molten metal 20. Any conventional degassing means may be suitable, but the degasser most suitable for use in the present invention is a rotating bubble dispersion device.

The degassed molten metal 20 enters a filtering medium 24, such as a non-nickel-bearing stainless steel filter. The filtering medium 26 sifts out inclusions and oxides from the degassed molten metal 24 to form a filtered melt 28 (FIG. 1). Preferably, the stainless steel screen has a average mesh size of 0.045.

The transferring means 30 includes a heated delivery tube and a pump suitably located in relation to each melting furnace 16 so that the filtered melt 28 may be transferred from each melting furnace 16 without exposure to air and without significant loss of thermal energy. The filtered melt then enters a holding or casting furnace 32. Like the one or more melting furnaces 16, the casting furnace 32 also has a protective atmosphere under which the filtered melt 28 may be made quiescent to reduce its kinetic energy, thereby permitting inclusions and oxides to settle and form a purified melt 36.

Connected to the holding furnace 32 is another heated means for transferring the purified melt from the holding furnace 32.

A final member of the manufacturing apparatus of the present invention is a casting press 38 which has a die cavity 40 and an entrance 42 thereto. The heated means for transferring the purified melt from the holding furnace is in communication with the entrance 42 of the casting press 38.

A means 44 for applying a vacuum to the die cavity is also in communication with the casting press 38. In an evacuation step, the vacuum application means 44 removes air from a delivery to be associated with the die cavity, the entrance thereto, and from the die cavity itself and displaces it with an inert atmosphere, such as argon. When the die cavity 40 is evacuated and occupied with the inert gas, a charging means 46, such as a ram, moves along a barrel of the casting press 38 and past a port 52, through which the purified melt 36 is inducted into the entrance 42 of the casting press 38. After movement of the charging means such as ram 46 past the port 52, the die cavity 40 is isolated from any further purified melt 36 entering into the charging means 46.

The inert atmosphere in the die cavity 40 serves to prevent burning and formation of accompanying reaction products.

To promote directional solidification, heating lines 54 are provided in the die 54. Cooling lines 56 may also be provided.

Having described the apparatus for manufacturing light metal castings, the main process steps will now be described. Those process steps are:

1. preheating charges or ingots 14 of the light metal in a protective atmosphere 18 so that they retain their solidified state, expel volatile substances, and avoid excessive heat losses of the melt in the melting furnace 16 to which the ingots 14 are introduced;
2. introducing the preheated ingots 14 into the melting furnace 16 in the protective atmosphere 18 to prepare molten metal 22;
3. degassing the molten metal 22 to remove dissolved gas, remove suspended oxides and inclusions and form degassed molten metal 24;
4. passing the degassed molten metal 24 through a filtering medium 26 to sift out nonmetallic and metallic oxide inclusions and form a filtered melt 28;
5. transferring the filtered melt 28 without exposure to air in a heated delivery tube for reducing loss of thermal energy to a covered holding furnace 32 also having a protective atmosphere 34;
6. making the filtered melt 28 quiescent to reduce its kinetic energy, thereby permitting inclusions to settle and form a purified melt 36;
7. applying a vacuum to a casting press 38 having a die cavity 40 and an entrance 42 to displace air residing in the die cavity 40 with an inert atmosphere;
8. transfer the purified melt 36 as a charge into the casting press 38 in the inert atmosphere to prevent burning and formation of accompanying reaction products;
9. displacing the charge by a piston into the die cavity 40; and
10. allowing the charge to cool and form the light metal casting in the absence of air with minimum defects and inclusions.

Additional detail of the process and apparatus of the present invention will now be provided.

If molten magnesium is used in the process or apparatus of the present invention, there is a requirement for protection against surface oxidation. The present invention addresses the need to handle molten metal in such a way as to eliminate flux. The advantages of using the disclosed protective atmosphere including $SF_6$ is to allow a pronounced decrease in metal loss during melting, as well as avoiding flux contamination in the castings. Additionally, the casting environment is not permeated by a corrosive atmosphere.

The closed heated transfer means permit a variety of manufacturing apparatus configurations. FIG. 2 depicts a system in which there are two melting furnaces 16 which connect by heated transfer tubes 30 to a casting furnace 32. This in turn feeds a two furnace melting system.

The furnaces of the present invention typically consist of an outer steel cover, with a bricked up ceramic insulation inside. Typical thicknesses of the insulation may be 200 mm. Temperature control of the metal is ensured by multiple thermocouples to prevent overheating. A steel tube may be necessary for protecting each thermocouple in the melt.

In order to prevent the melt from oxidation, the protective gas mixture is supplied beneath a lid covering each furnace. The typical composition of the protective gas is 0.2% $SF_6$, 20–50% $CO_2$, and the balance dry air. Preferably, the air should be dried to less than 800 ppm $H_2O$. Preferably, the range of operating temperature in the holding furnace 36 ranges from 1200°–1300° F. Under operating conditions in which the temperature is in the upper range for regions of this range and higher, the protective gas may have 0.7% $SF_6$, with the balance $CO_2$ and air.

The transfer tubes preferably are made of a nickel-free, high-chromium, titanium-modified steel. Electric resistance heating elements are wound onto each tube throughout its whole length. It is desirable that the spacing be equal between each loop of the element. Other methods of reducing heat loss include insulating the length of the tube and/or by external flame heating of the tube.

If contaminated with impurities (oxides, dross), the delivery tubes may become blocked, thereby impeding the transfer of molten metal. If necessary, the delivery tubes may be emptied and cleaned in diluted hydrochloric acid. A suitable cleaning agent is made by diluting concentrated (37% hydrochloric) acid 1:10 in water, and adding 0.2% of Polyrad 1110A as an inhibitor.

Returning to FIG. 1, it may be desirable to apply a lubricant into the die cavity 40 before molten metal is introduced therein. A lubricant may also advantageously be applied to the entrance 42 of the casting press 38.

As also depicted in FIG. 1, heating and cooling lines 54, 56 are provided around the die cavity 40 to promote directional solidification if desired depending, among other things, on part geometry and design criteria.

It will be appreciated that FIG. 1 depicts an embodiment of the apparatus in which the direction of movement of the ram 46 displaces the molten charge against gravitational forces. It will be appreciated that orientations of the casting press 38 are possible such that the direction of movement of the ram 46 may be, for instance, horizontal.

It will also be appreciated that the heating lines 54 may serve as cooling lines, and that the cooling lines 56 may serve as heating lines, depending on the design requirements of the component being cast.

While the degassing step is depicted as occurring before the filtering step, if desired, the sequence of these operations may be interchanged.

Preferably, a light metal alloy to which the disclosed invention is suitable is the magnesium AM50B alloy.

The isolation feature provided by the closed protective atmosphere prevents pickup of hydrogen, reduces reaction and oxidation products, gas entrainment, and decreases melt losses, while reducing fire hazards. The degassing and filtering steps remove any dissolved gas, large oxidation products from charging ingots, melt slag, and cover gas reaction products, plus dross. The settling step during quiescence allows finer nonmetallic inclusions to settle.

With the use of two melting furnaces, production may continue uninterrupted with no decrease in metal cleanliness.

The vacuum siphoning system incorporating an integral gas purge valve (48) allows the addition of an inert gas into the metal delivery system which prevents the molten metal from contacting air as the molten metal is ladled in by the vacuum. The inert gas acts as a barrier layer which prevents formation of accompanying reaction products. Heating and transfer in holding equipment permits the metal to be retained at a castable temperature so as to decrease the total loss of thermal energy. Accordingly, super heat is kept to a minimum. This reduces total melt losses, increases the usable life of the casting equipment, and decreases energy requirements.

If desired, the filtering medium may be embodied in a large mesh screen which filters out large nonmetallic inclusions, together with a smaller mesh screen which enables the filtration of finer nonmetallic inclusions.

Upon entering the casting furnace, the metal is allowed to slow down, which quiets the molten metal, thereby allowing very fine nonmetallic inclusions to precipitate out.

If is often helpful to introduce the metal charge slowly into the die cavity under the inert cover gas. If desired, this step may be undertaken with the assistance of the vacuum.

Using the disclosed process, depending on the part to be cast, cycle time may be reduced to 1½ minutes as compared to 4 minutes, which is often required for permanent molding of aluminum.

Thus, there has been disclosed an apparatus and method for preparing light metal casting with minimum porosity and defects. The types of castings to which the disclosed invention may be applicable are varied and include but are not limited to wheels and suspension arms.

In the disclosed invention, there is complete isolation of molten magnesium from atmospheric air. There are two stages of metal cleaning, including degassing and filtering in phase I and settling in phase II. Also disclosed is a vacuum siphoning system which incorporates an integral gas purge valve. Provision is also made for heating all transfer and holding equipment.

It will be clear to those skilled in the art of constructing die assemblies that various modifications and changes could be made to the assembly described without departing from the spirit and scope of this invention. Accordingly, all such modifications and changes as fall within the scope of the appended claims are intended to be part of this invention.

We therefore claim:

1. A process for casting light metals in an apparatus having a heated die cavity in fluid communication with a closed holding furnace, a ram movable within a barrel opening into the die cavity and heating and cooling lines for directional solidification, the process comprising:

A. applying a vacuum to the die cavity;

B. providing a flow of inert gas to the die cavity so that a barrier of inert gas is placed between incoming molten metal and air being evacuated from the die cavity;

C. providing a flow of purified molten metal from an upper quiescent region of the holding furnace to avoid impurities settling or settled in lower regions of the holding furnace, the flow occurring along a heated transfer tube through a port provided in the barrel to minimize loss of thermal energy;

D. moving the ram upwardly within the barrel from below the port to close the port as the ram moves upwardly, thereby excommunicating the flow of molten metal, while continuing application of the vacuum to evacuate inert gas from the die cavity until the cavity is filled with molten metal that is free of inclusions due to isolation of the molten metal from air; and E. applying thermal energy to the heating and cooling lines located above, below, and around the die cavity in order to achieve directional solidification of the molten metal so that distal regions of the molten metal in the die cavity solidify before proximal regions thereof located adjacent an entrance of the die cavity through which the molten metal flows from the barrel and so that premature solidification is avoided.

2. The process of claim 1 further including the steps of:

applying a lubricant into the die cavity before molten metal is introduced into the entrance of the casting press.

* * * * *